US006245441B1

(12) United States Patent
Yokoyama et al.

(10) Patent No.: US 6,245,441 B1
(45) Date of Patent: Jun. 12, 2001

(54) COMPOSITE MAGNETIC MEMBER EXCELLENT IN CORROSION RESISTANCE AND METHOD OF PRODUCING THE SAME

(75) Inventors: Shin-ichiro Yokoyama, Yasugi; Tsutomu Inui, Yonago; Yoshihiro Tanimura, Kariya, all of (JP)

(73) Assignees: Hitachi Metals, Ltd., Tokyo; Denso Corporation, Aichi, both of (JP)

( * ) Notice: Subject to any disclaimer, the term of this patent is extended or adjusted under 35 U.S.C. 154(b) by 0 days.

(21) Appl. No.: 09/335,909

(22) Filed: Jun. 18, 1999

(30) Foreign Application Priority Data

Jun. 22, 1998 (JP) ..... 10-174249

(51) Int. Cl.[7] ..... H01F 1/00; H01F 1/147

(52) U.S. Cl. ..... 428/611; 148/120; 148/121; 148/122; 148/310; 335/296; 428/638; 428/686; 428/900; 428/928

(58) Field of Search ..... 428/611, 638, 428/686, 900, 928; 148/120, 121, 122, 310, 325, 336; 420/34, 119; 335/296

(56) References Cited

U.S. PATENT DOCUMENTS

| | | | | |
|---|---|---|---|---|
| 3,960,617 | | 6/1976 | Levin et al. | 148/121 |
| 5,821,000 | * | 10/1998 | Inui et al. | 428/611 |
| 5,841,212 | | 11/1998 | Mita et al. | 310/156 |
| 5,865,907 | | 2/1999 | Katayama et al. | 148/120 |

FOREIGN PATENT DOCUMENTS

| | | | |
|---|---|---|---|
| 9-157802 | 6/1997 | (JP) | C22C/38/00 |
| 9-228004 | 9/1997 | (JP) | C22C/38/00 |
| 9-285050 | 10/1997 | (JP) | H02K/1/27 |

* cited by examiner

*Primary Examiner*—Deborah Jones
*Assistant Examiner*—Robert R. Koehler
(74) *Attorney, Agent, or Firm*—Sughrue, Mion, Zinn, Macpeak & Seas, PLLC

(57) ABSTRACT

This is a composite magnetic member excellent in corrosion resistance having a chemical composition consisting essentially, by weight, of 0.30 to 0.80% C, more than 16.0% but not more than 25.0% Cr, 0.1 to 4.0% Ni, 0.1 to 0.06% N, at least one kind not more than 2.0% in total selected from the group consisting of Si, Mn and Al, and the balance Fe and impurities, and having a ferromagnetic portion and a non-magnetic portion.

9 Claims, 1 Drawing Sheet

(×3000)

10 μm (×3000)

10 μm

COMPOSITE MAGNETIC MEMBER EXCELLENT IN CORROSION RESISTANCE AND METHOD OF PRODUCING THE SAME

BACKGROUND OF THE INVENTION

1. Field of the Invention

The present invention relates to a composite magnetic member combining a ferromagnetic portion and a non-magnetic portion suitable for use in an actuator which treats with automobile fuels and hydraulic operating fluids or the like (hereinafter referred to as an oil controlling device).

2. Description of the Related Art

An oil flow controlling device of an automobile conventionally has a structure in which an effective use of magnetic flux is made by providing a non-magnetic portion in a part of a stator, which stator is ferromagnetic (generally, soft magnetism), to cause magnetic flux to flow to a movable piece. Techniques such as the brazing and laser welding of a ferromagnetic part and a non-magnetic part have been employed to provide a non-magnetic portion in a part of the ferromagnetic portion. In contrast to these techniques of bonding dissimilar materials, the present authors propose the use of a single material as a composite magnetic material which is formed by providing a ferromagnetic portion and a non-magnetic portion by cold working or heat treatment. When such composite magnetic materials made of a single material are used, it is possible to obtain parts superior to those obtained by bonding a ferromagnetic portion and a non-magnetic portion with respect to ensuring airtightness and ensuring reliability, such as prevention of breakage by vibrations, etc.

In Japanese Patent Unexamined Publication No. 9-157802 based on a proposal by the present inventors, for example, a martensitic stainless steel containing 0.5 to 4.0% Ni is disclosed as a composite magnetic member suitable for an oil controlling device of an automobile. This proposal is such that in a martensitic stainless steel composed of ferrite and carbides in an annealed condition, the austenite in a non-magnetic portion having a permeability ($\mu$) of not more than 2, which portion is obtained by cooling a part of the martensitic stainless steel after heating, is stabilized by adding an appropriate amount of Ni to a C-Cr-Fe-base alloy from which ferromagnetic properties with a maximum permeability ($\mu$m) of not less than 200 are obtained, whereby it is possible to lower the Ms point (temperature at which austenite begins to be transformed into martensite) to not more than −30° C.

Also, Japanese Patent Unexamined Publication No. 9-228004 based on a proposal by the present applicant discloses that in a composite magnetic material used in magnetic scales etc., by adding more than 2% but not more than 7% Mn and 0.01 to 0.05% N to a C-Cr-Fe-base alloy containing 10 to 16% Cr and 0.35 to 0.75% C which alloy has ferromagnetic properties with a maximum permeability ($\mu$m) of not less than 200, it is possible to stabilize the retained austenite with a permeability ($\mu$) of not more than 2, which is obtained by cooling after heating, and to thereby lower the Ms point to not more than −10° C. These proposals are excellent in the respect that a ferromagnetic portion with a maximum permeability ($\mu$m) of not less than 200 and a stable non-magnetic portion with a permeability ($\mu$) of not more than 2 and a low Ms point can be obtained in a single material.

SUMMARY OF THE INVENTION

An object of the present invention is to provide a composite magnetic member excellent in corrosion resistance, which combines a ferromagnetic portion and a non-ferromagnetic portion in a single material, in the member the corrosion resistance of the ferromagnetic portion being improved whose structure is mainly composed of ferrite and carbides, and to provide also a method of producing the composite magnetic member.

The composite magnetic members disclosed in the above Japanese Patent Unexamined Publication No. 9-157802 and Japanese Patent Unexamined Publication No. 9-228004 have an advantage in being capable of combining a ferromagnetic portion with a maximum permeability ($\mu$m) of not less than 200 and a stable non-magnetic portion with a permeability ($\mu$)of not more than 2. However, in these composite magnetic members, the corrosion resistance of the ferromagnetic portion mainly composed of ferrite and carbides is inferior to that of the non-magnetic portion mainly composed of austenite, with the result that rust is apt to be formed on the surface of the ferromagnetic portion. Thus, these composite magnetic members had such a serious problem as their surfaces corrode and deteriorate when they are used in oil controlling devices of automobiles, etc.

The present inventors examined the microstructure of a ferromagnetic portion whose structure is mainly composed of ferrite and carbides in a composite magnetic material. As a result, they found out that the carbides are mainly composed of Cr carbides and that the formation of these Cr carbides causes Cr to be concentrated in the carbides, with the result that the Cr concentration is insufficient in the ferrite phase matrix near the carbides.

As a result of a further examination, the present inventors also found out that the corrosion of the ferromagnetic portion starts from a layer of deficient Cr concentration near Cr carbides as the initiation point and that the corrosion resistance of the ferromagnetic portion and hence the corrosion resistance of the composite magnetic material can be substantially improved by increasing the amount of Cr contained in the composite magnetic material to more than 16.0% by weight, thereby increasing the Cr concentration of the ferrite phase matrix to not less than 12.0% by weight.

In addition, the present inventors further examined the disclosure in Japanese Patent Unexamined Publication No. 9-228004 that it is difficult to form the austenite in the non-magnetic portion in a case of Cr concentrations exceeding 16.0% because the ferrite structure becomes stable at such high Cr concentrations.

The present inventors previously considered that because Cr is a ferrite-forming element, the ferrite phase becomes stable when the Cr concentration exceeds 16.0% and, therefore, it is difficult to obtain the non-magnetic phase of austenite even when solution treatment is performed. This time, however, they found out that, surprisingly, an austenite phase with a permeability ($\mu$)of not more than 2 is obtained when a material with a Cr concentration exceeding 16.0% was subjected to solution treatment at 1250° C. for 10 minutes.

As a consequence, the present inventors found out that when water cooling is performed after solution treatment is carried out at the temperature range of from 1050 to 1300° C. in the manufacturing process of a composite magnetic member, austenitizing is possible, in other words, non-magnetic portion can be obtained.

Furthermore, the present inventors found out that, by performing annealing at below the A3 transformation point after hot working, cold working and further annealing at below the A3 transformation point, it is possible to disperse carbides in the ferromagnetic portion having a maximum grain size range of 0.1 to 20 μm, so that, corrosion resistance can be improved without the deterioration of the conventional magnetic properties even when Cr is added in amounts exceeding 16.0% if they are not more than 25.0%.

In the present invention there is provided a composite magnetic member excellent in corrosion resistance having a chemical composition consisting essentially, by weight, of 0.30 to 0.80% C, more than 16.0% but not more than 25.0% Cr, 0.1 to 4.0% Ni, 0.1 to 0.06% N, at least one kind not more than 2.0% in total selected from the group consisting of Si, Mn and Al, and the balance Fe and impurities, and having a ferromagnetic portion and a non-magnetic portion.

The composite magnetic member of the present invention has such magnetic properties as the maximum permeability (μm) of the ferromagnetic portion is not less than 200 and the permeability (μ) of the non-magnetic portion is not more than 2.

The composite magnetic member of the present invention has a ferromagnetic portion with a maximum grain size of carbides controlled to the range of from 0.1 to 20 μm.

The maximum grain size of carbides in the ferromagnetic portion of the composite magnetic member of the present invention is preferably controlled to the range of from 5 to 20 μm.

A method of producing the composite magnetic member of the present invention comprises the steps of hot working a material for this composite magnetic member, annealing the material at a temperature below the A3 transformation temperature, cold working it, and annealing it again at a temperature below the A3 transformation temperature to obtain a ferromagnetic body, and locally heating and cooling a part of the ferromagnetic body thus obtained to form a non-magnetic portion. A composite magnetic member excellent in corrosion resistance can be obtained by this method.

In this method of producing a composite magnetic member excellent in corrosion resistance, the maximum grain size of carbides in the above ferromagnetic portion is controlled preferably to the range of from 0.1 to 20 μm, and more preferably to the range of from 5 to 20 μm.

DETAILED DESCRIPTION OF THE PREFERRED EMBODIMENTS

Figure 1:
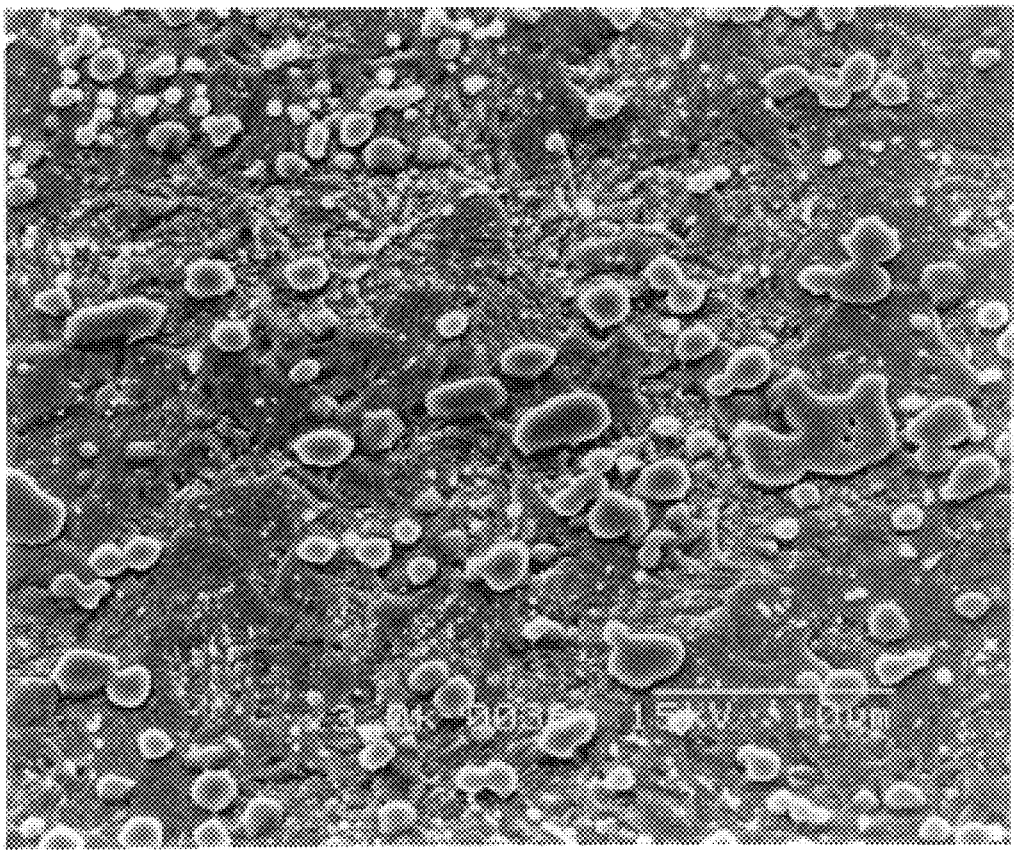
FIG. 1 is a micrograph showing an example of the composite magnetic portion of the present invention.

As mentioned above, an important feature of the present invention resides in that in order to improve the corrosion resistance of a ferromagnetic portion of the composite magnetic member comprising ferrite and Cr carbides, the amount of Cr contained in the base material of the composite magnetic member is increased to concentrations of more than 16.0% by weight, whereby the Cr concentration of the ferrite phase matrix near the carbides is increased to not less than 12.0%.

Reasons for the limited chemical composition of the present invention are described below.

Cr is the most important element of the present invention that exists in the matrix in a solid solution state and partially becomes carbides, ensuring the mechanical properties and corrosion resistance of the present invention. The reason why the range of Cr concentration of the present invention is more than 16.0% but not more than 25.0% is that the Cr concentration of the ferrite phase matrix near Cr carbides becomes not more than 12.0% when the Cr concentration of the present invention is not more than 16.0%. This is also because ferromagnetism with a maximum permeability (μm) of not less than 200 cannot be obtained when inversely the Cr concentration of the present invention exceeds 25.0%. The more preferred range of Cr concentration is more than 16.0% but not more than 20.0%.

C is an important element that forms carbides and ensures the strength of a C-Ni-Cr-Fe-base alloy which is basic to the present invention. Also, C is an element that contributes to the stabilization of austenite. When the C concentration is less than 0.30%, it becomes difficult to obtain an austenite structure stable at a temperature below room temperature, when cooled after heating to above the austenite transformation temperature. On the other hand, at C concentration exceeding 0.80%, cold working becomes difficult because materials become too hard. For this reason, the range of C concentration specified in the present invention is 0.30 to 0.80%. The more preferred range of C concentration is 0.45 to 0.65%.

Ni is an element that effectively lowers the Ms point of the non-magnetic portion. The reason why the range of Ni concentration of the present invention is 0.1 to 4.0% is that the Ms point of the non-magnetic portion does not easily decrease at Ni concentrations of less than 0.1%, whereas forming is difficult at Ni concentrations exceeding 4.0%, and it becomes difficult to obtain good soft magnetic properties.

N is an element that has the same effect as Ni as an austenite-forming element. The reason why the range of N concentration of the present invention is 0.01 to 0.06% is that its effect on a decrease in the Ms point of the non-magnetic portion is small at N concentrations of less than 0.01%, whereas formability deteriorates because of excessive hardness at N concentrations exceeding 0.06%. Incidentally, the member of the present invention may include at least one kind selected from the group consisting of Si, Mn and Al as a deoxidizer in an amount of not more than 2% in total so far as the magnetic properties are not deteriorated thereby.

Next, reasons for the limited permeability of the present invention are described below.

The member of the present invention is composed of a ferromagnetic portion and a non-magnetic portion and the reason why the maximum permeability (μm) of the ferromagnetic portion of the present invention is not less than 200 is that this range is a necessary characteristic for the member of an oil controlling device, which is one of the applications of the composite magnetic member of the present invention.

The reason why the permeability (μ) of the non-magnetic portion of the present invention is not more than 2 is that magnetic flux flows easily when this range is exceeded, with the result that the non-magnetic portion does not play its role as such.

Next, reasons for the limited maximum grain size of carbides are described below.

In the present invention it is preferable that the maximum grain size of carbides of ferromagnetic portion be controlled to the range of 0.1 to 20 μm. This is because the amount of C that exist in the ferrite phase matrix in a solid solution state becomes too much in a case of ranges less than 0.1 μm, and it is impossible to obtain a maximum permeability (μm) of not less than 200, which is necessary for the ferromagnetic portion. On the other hand, when the maximum grain size of carbides exceeds 20 μm, formability deteriorates and, at the same time, the amount of C that exists in the ferrite phase matrix in a solid solution state becomes insufficient, with the result that a non-magnetic austenite phase cannot be easily obtained even when solution treatment is performed. The preferred range of maximum grain size of carbides is 5 to 20 μm.

When in the present invention, the maximum grain size of carbides of the above ferromagnetic portion in particular is controlled to the range of 5 to 20 μm, it is easy to obtain such magnetic properties as the maximum permeability (μm) of the ferromagnetic portion is not less than 230. Therefore, this is especially preferred.

Next, the reason for the limitations regarding the manufacturing process of the present invention is described below.

In the present invention, hot working is an important process for controlling the maximum grain size of carbides and the heating temperature range is especially preferably from 900 to 1100° C. This is because the amount of C that exists in the matrix in a solid solution state is small at heating temperatures less than 900° C. and the maximum grain size of carbides exceeds 20 μm, whereas the amount of C in a solid solution state becomes too much at temperatures exceeding 1100° and carbides with a maximum grain size of not less than 0.1 μm cannot be obtained.

Furthermore, the reason why annealing is performed at a temperature not more than the A3 transformation point after hot working is that carbides are made to grow, thereby lowering the hardness of the member and facilitating the cold working after that. In other words, this is because the growth of carbides is not sufficient at temperatures more than the A3 transformation point and hence the effect of annealing on a decrease in hardness is small.

The A3 transformation point in this invention is a temperature at which the ferrite phase begins to be transformed into the austenite phase and this temperature varies in dependence upon a chemical composition of the material.

The A3 transformation temperature decreases when the amount of added C, Ni, N, etc., which are austenite-forming elements, increases. On the other hand, the A3 transformation temperature rises when the amount of added Cr, which is a ferrite-forming element, increases. In the range of chemical composition of the material specified in the present invention, the A3 transformation point is in the range of from 650 to 1000° C.

The reason why cold working is performed is that the strain-induced precipitation of carbides occurs by giving strains to the member and it is effective to adopt working ratios of from 40 to 90%.

The reason why annealing is performed again at a temperature not more than the A3 transformation point after cold working is that the carbides which precipitate during cold working are made to grow, whereby the maximum grain size of carbides is stabilized in the range of 0.1 to 20 μm.

The more preferred range of annealing to be performed after hot working and cold working is from the A3 transformation point to a temperature less than the A3 transformation point by 200° C.

The grain size of carbides can be easily controlled to the range of from 5 to 20 μm by adopting the above method of the present invention.

In the present invention, as a method of providing a non-magnetic portion in a part of the member made to be ferromagnetic by the above process, it is preferable that a part of the member be partially heated and subjected to solution treatment by high-frequency heating, laser heating, etc. and rapidly cooled after that. The solution treatment on this occasion is especially effective in the temperature range of from 1050 to 1300° C. at which the austenite phase is obtained. Furthermore, as a cooling method, it is preferable to perform rapid cooling by water cooling, etc. immediately after heating.

In the present invention, even when the amount of added Cr is increased, the above manufacturing process enables the non-magnetic portion to be easily formed in the ferromagnetic body without the deterioration of the magnetic properties and, at the same time, permits the corrosion resistance of the ferromagnetic portion to be improved.

EXAMPLE 1

Because the Cr content is important in the present invention, 10-kg ingots with various Cr contents were obtained by vacuum melting. These ingots were then forged, and hot rolling at 1000° C. was performed to produce 4.0-mm thick plates. The material was annealed at 780° C. below the A3 transformation temperature, oxide scale was removed, and sheets 1.5 mm in thickness were obtained by cold rolling. Table 1 shows the chemical compositions of the members tested.

In the members Nos. 1 to 7, the amounts of added C, Si, Ni, Mn, etc., were almost the same and the amount of added Cr was varied. The amount of added Cr was lowered in the member No. 6 and increased in the member No. 7.

The member No. 8 is the composite magnetic member described in JP-A-9-157802.

TABLE 1

| No. | C | Si | Cr | Ni | Mn | Al | N | Fe | Remarks |
|---|---|---|---|---|---|---|---|---|---|
| 1 | 0.54* | 0.19 | 16.4 | 0.98 | 0.51 | 0.02 | 0.02 | the balance | the invention |
| 2 | 0.54 | 0.19 | 17.5 | 0.97 | 0.51 | 0.01 | 0.03 | the balance | the invention |
| 3 | 0.54 | 0.19 | 19.2 | 0.95 | 0.51 | 0.03 | 0.02 | the balance | the invention |
| 4 | 0.53 | 0.20 | 21.7 | 0.96 | 0.51 | 0.02 | 0.05 | the balance | the invention |
| 5 | 0.54 | 0.19 | 24.3 | 0.95 | 0.50 | 0.02 | 0.05 | the balance | the invention |
| 6 | 0.54 | 0.19 | 13.9 | 1.00 | 0.53 | 0.02 | 0.02 | the balance | comparative example |

TABLE 1-continued

| No. | C | Si | Cr | Ni | Mn | Al | N | Fe | Remarks |
|---|---|---|---|---|---|---|---|---|---|
| 7 | 0.54 | 0.19 | 25.8 | 0.98 | 0.54 | 0.02 | 0.04 | the balance | comparative example |
| 8 | 0.62 | 0.22 | 13.6 | 3.96 | 0.50 | 0.02 | 0.02 | the balance | comparative example |

*weight %

This cold-rolled material was annealed at 780° C. below the A3 transformation point and was made ferromagnetic. A part of the sample obtained was heated by high-frequency heating and held at about 1250°C. for 10 minutes followed by water cooling. A sample which became partially non-magnetic was thus obtained. The surface of this sample was polished with paper and the salt spray testing was then carried out by the method described in JIS Z2371 to evaluate corrosion resistance from the rusting condition of sample surface. In the present invention, salt was sprayed on the sample for 100 hours as an index of corrosion resistance and corrosion resistance was judged by whether or not rust is observed on the surface of the member. The result of this judgment is shown in Table 2 by the marks ○ and X.

The Cr concentration of the ferrite phase near the carbides of ferromagnetic portion was measured with an X-ray microanalyzer and the size of Cr carbides was observed. As a result, it was observed that the CR carbides of all members have a maximum grain size of about 7 μm. The microstructure of the ferromagnetic portion of the member No. 2 is shown in FIG. 1 as an example of observation of carbides.

Furthermore, the maximum permeability (μm) in portions other than the heat-affected zone obtained by high-frequency heating was seeked and the magnetic properties of the ferromagnetic portion was evaluated. On the other hand, it was ascertained by an X-ray diffraction analysis that a phase mainly composed of retained austenite is formed in the non-magnetic portion obtained by high-frequency heating and the permeability (μ) and Ms point of the non-magnetic portion were measured. A permeameter and a differential scanning type calorimeter were used for these measurements. The results of the measurement are shown in Table 2.

TABLE 2

| | Ferromagnetic Portion | | | Non-magnetic portion | | | |
|---|---|---|---|---|---|---|---|
| | Cr | | | | | | |
| No. | concentration of ferrite phase (wt. %) | corrosion resistance | μm | corrosion resistance | μ | Ms (° C.) | Remarks |
| 1 | 12.2 | ○ | 680 | ○ | 1.51 | −42 | the invention |
| 2 | 14.7 | ○ | 537 | ○ | 1.24 | −38 | the invention |
| 3 | 15.8 | ○ | 416 | ○ | 1.03 | −39 | the invention |
| 4 | 19.5 | ○ | 325 | ○ | 1.01 | −39 | the invention |
| 5 | 22.1 | ○ | 211 | ○ | 1.02 | −39 | the invention |
| 6 | 10.5 | X | 722 | ○ | 1.40 | −48 | comparative example |
| 7 | 23.7 | ○ | 192 | ○ | 1.39 | −40 | comparative example |
| 8 | 10.1 | X | 260 | ○ | 1.01 | −48 | comparative example |

○: no occurrence of rust
X: occurrence of rust

In the non-magnetic portion, no rust was observed on the sample surface of any member, as shown in Table 2. In the samples of the members of the present invention with a Cr content of more than 16.0% but not more than 25.0%, the Cr concentration of the ferromagnetic ferrite phase was kept at levels of not less than 12.0%, rusting was not observed as in the non-magnetic portion, and good corrosion resistance was shown. It was ascertained that excellent ferromagnetic properties with a maximum permeability (μm) of more than 200 were obtained in the ferromagnetic portion and that the permeability (μ) of the non-magnetic portion was not more than 2.

In the samples of the member of the present invention, the permeability (μ) and Ms point in the non-magnetic portion are almost the same as those of the composite magnetic portion disclosed in JP-A-9-157802, i.e., the member No. 8. Thus, it is apparent that in the member of the present invention, the characteristics of the non-magnetic portion necessary for a composite magnetic member can be maintained. On the other hand, in the members No. 6 and No. 8 with a Cr content not exceeding 16.0%, rust is observed in the ferromagnetic portion although excellent magnetic properties are obtained. Thus, it is apparent that the members No. 6 and No. 8 are inferior to the member of the present invention in corrosion resistance. It is apparent that in the sample No. 7 with a Cr content exceeding 25.0%, a maximum permeability ($\mu$m) of 200 cannot be obtained in the ferromagnetic portion although excellent corrosion resistance is obtained.

EXAMPLE 2

The maximum grain size of carbides in the ferromagnetic portion is also important in the present invention. Therefore, for the member No. 2 shown in Table 1, which is one of the members of the present invention, the hot working temperature was varied in the range of from 850 to 1150° C. and corrosion resistance and magnetic properties were investigated by measuring the maximum grain size of carbides in the ferromagnetic portion. After the mirror polishing of the member, chemically etched samples were observed under a scanning electron microscope in more than 10 fields of a magnification of 3000 and the maximum grain size of carbides observed. The member manufacturing process except the hot working temperature and the investigation methods of corrosion resistance and magnetic properties are the same as with Example 1. The results of the investigation are shown in Table 3.

TABLE 3

| | | Ferromagnetic Portion | | | Non-magnetic portion | | | |
|---|---|---|---|---|---|---|---|---|
| No. | Hot working temperature (° C.) | Maximum grain size of carbide ($\mu$m) | corrosion resistance | $\mu$m | corrosion resistance | $\mu$ | Ms (° C.) | Remarks |
| 11 | 900 | 12.70 | ○ | 249 | ○ | 1.23 | −35 | the invention |
| 12 | 1000 | 7.10 | ○ | 237 | ○ | 1.03 | −39 | the invention |
| 13 | 1050 | 0.61 | ○ | 229 | ○ | 1.16 | −37 | the invention |
| 14 | 1100 | 0.15 | ○ | 203 | ○ | 1.34 | −36 | the invention |
| 15 | 1150 | 0.06 | ○ | 188 | ○ | 1.21 | −42 | comparative example |
| 16 | 850 | 21.10 | ○ | 280 | ○ | 2.24 | −18 | comparative example |

○: No rust occurred
X: Rust occurred

As shown in Table 3, it is apparent that the member No. 2 provides excellent corrosion resistance at all hot working temperatures.

Furthermore, in the members Nos. 11 to 14 whose maximum grain size of carbides was controlled to the range of from 0.1 to 20 $\mu$m, corrosion resistance is excellent and the requirements for magnetic properties, i.e., a maximum permeability ($\mu$m) of not less than 200 in the ferromagnetic portion and a permeability ($\mu$) of not more than 2 in the non-magnetic portion are met. Among others, the members Nos. 11 and 12 in which the maximum grain size of carbides was controlled to the range of from 5 to 20 $\mu$m, have excellent magnetic properties with a maximum permeability ($\mu$m) of not less than 230 in the ferromagnetic portion.

On the other hand, in the member No. 15 whose maximum grain size of carbides is under 0.1 $\mu$m, a maximum permeability ($\mu$m) of not less than 200 in the ferromagnetic portion cannot be obtained although excellent corrosion resistance and non-magnetic properties are obtained.

Inversely, it is apparent that in the member No. 16 whose maximum grain size of carbides exceeds 20 $\mu$m, a non-magnetic portion with a permeability ($\mu$) of not more than 2 cannot be obtained although excellent corrosion resistance and ferromagnetic properties are obtained. It is also apparent that hot working temperatures between 900 and 1100° C. are effective in controlling the maximum grain size of carbides to the range of from 0.1 to 20 $\mu$m.

According to the present invention, in a single material having a ferromagnetic portion and a non-magnetic portion, by increasing the Cr content of a C-Ni-Cr-Fe-base alloy to more than 16.0% but not more than 25.0% and performing hot working and solution treatment in an appropriate temperature range, it is possible to dramatically improve the corrosion resistance of the ferromagnetic portion composed of ferrite and carbides and to obtain a stable non-magnetic portion having the same magnetic properties as conventionally. Thus, the present invention provides a technique that is indispensable for the application of a composite magnetic member to an oil controlling device of an automobile.

What is claimed is:

1. A composite magnetic member excellent in corrosion resistance having a chemical composition consisting essentially, by weight, of 0.30 to 0.80% C, more than 16.0% but not more than 25.0% Cr, 0.1 to 4.0% Ni, 0.01 to 0.06% N, not more than 2.0% in total selected from the group consisting of Si, Mn and Al, and the balance Fe and impurities, and having a ferromagnetic portion and a non-magnetic portion.

2. A composite magnetic member excellent in corrosion resistance according to claim 1, wherein said ferromagnetic portion has a maximum permeability ($\mu$m) of not less than 200, said non-magnetic portion having permeability ($\mu$) of not more than 2.

3. A composite magnetic member excellent in corrosion resistance according to claim 1, wherein said ferromagnetic portion has a maximum grain size of carbides controlled to the range of from 0.1 to 20 $\mu$m.

4. A composite magnetic member excellent in corrosion resistance according to claim 1, wherein said ferromagnetic portion has a maximum grain size of carbides controlled to the range of from 5 to 20 $\mu$m.

5. A composite magnetic member excellent in corrosion resistance according to claim 1, wherein said ferromagnetic portion has a maximum permeability ($\mu$m) of not less than 200, said non-magnetic portion having permeability ($\mu$) of not more than 2, said ferromagnetic portion having a maximum grain size of carbides controlled to the range of from 0.1 to 20 $\mu$m.

6. A composite magnetic member excellent in corrosion resistance according to claim 1, wherein said ferromagnetic portion has a maximum permeability ($\mu$m) of not less than 200, said non-magnetic portion having permeability ($\mu$) of not more than 2, said ferromagnetic portion having a maximum grain size of carbides controlled to the range of from 5 to 20 $\mu$m.

7. A method of producing a composite magnetic member excellent in corrosion resistance having a chemical composition consisting essentially, by weight, of 0.30 to 0.80% C, more than 16.0% but not more than 25.0% Cr, 0.1 to 4.0% Ni, 0.01 to 0.06% N, not more than 2.0% in total selected from the group consisting of Si, Mn and Al, and the balance Fe and impurities, comprising the steps of hot working a material, annealing said material at a temperature below the A3 transformation temperature, cold working said material, further annealing at a temperature not more than the A3 transformation temperature to obtain a ferromagnetic body, and local heating and cooling of a part of said ferromagnetic body to thereby form a non-magnetic portion.

8. A method of producing a composite magnetic member excellent in corrosion resistance according to claim 7, wherein said ferromagnetic portion has a maximum grain size of carbides controlled to the range of from 0.1 to 20 $\mu$m.

9. A method of producing a composite magnetic member excellent in corrosion resistance according to claim 7, wherein said ferromagnetic portion has a maximum grain size of carbides controlled to the range of from 5 to 20 $\mu$m.

* * * * *